US010522901B2

(12) United States Patent
Xiong et al.

(10) Patent No.: US 10,522,901 B2
(45) Date of Patent: Dec. 31, 2019

(54) TERMINAL CASING AND TERMINAL

(71) Applicant: XIAOMI INC., Haidian District, Beijing (CN)

(72) Inventors: Xiaofeng Xiong, Beijing (CN); Zonglin Xue, Beijing (CN); Linchuan Wang, Beijing (CN)

(73) Assignee: XIAOMI INC., Beijing (CN)

( * ) Notice: Subject to any disclaimer, the term of this patent is extended or adjusted under 35 U.S.C. 154(b) by 246 days.

(21) Appl. No.: 15/368,872

(22) Filed: Dec. 5, 2016

(65) Prior Publication Data

US 2017/0162933 A1 Jun. 8, 2017

(30) Foreign Application Priority Data

Dec. 3, 2015 (CN) ..... 2015 1 0881118

(51) Int. Cl.
*H01Q 1/24* (2006.01)
*H01Q 1/48* (2006.01)
*H01Q 9/04* (2006.01)

(52) U.S. Cl.
CPC ..... *H01Q 1/243* (2013.01); *H01Q 1/48* (2013.01); *H01Q 9/0421* (2013.01)

(58) Field of Classification Search
CPC ..... H01Q 1/243
See application file for complete search history.

(56) References Cited

U.S. PATENT DOCUMENTS 8,847,828 B1 9/2014 Lee et al.
9,048,528 B1 6/2015 Lee et al.
2014/0306857 A1 10/2014 Bevelacqua et al.
2015/0318601 A1 11/2015 Lin
2015/0349404 A1 12/2015 Wang
2016/0233574 A1 8/2016 Xiong et al.
2016/0365623 A1 12/2016 Kim et al.
2017/0048363 A1* 2/2017 Lee ..... H01Q 1/243

FOREIGN PATENT DOCUMENTS

CN 104103888 A 10/2014
CN 203895602 U 10/2014
CN 203932323 U 11/2014
CN 104577334 A 4/2015
CN 204391272 U 6/2015
CN 105006647 A 10/2015
CN 105024160 A 11/2015
(Continued)

OTHER PUBLICATIONS

International Search Report issued in corresponding International Application No. PCT/CN2016/100687, dated Nov. 29, 2016, 4 pages.

(Continued)

*Primary Examiner* — Robert Karacsony
(74) *Attorney, Agent, or Firm* — Arch & Lake LLP

(57) ABSTRACT

A terminal casing and a terminal are provided. A bottom frame is divided into a horizontal part and two perpendicular parts by two gaps in the bottom frame of a metal frame; and a first feeder unit and a second feeder unit are arranged in a clearance area, the first feeder unit and the horizontal part of the bottom frame form a first antenna unit, and the second feeder unit and any perpendicular part form a second antenna unit orthogonal to the first antenna unit.

17 Claims, 3 Drawing Sheets

(56) References Cited

FOREIGN PATENT DOCUMENTS

| | | | |
|---|---|---|---|
| CN | 105958201 | A | 9/2016 |
| EP | 3057176 | A1 | 8/2016 |
| EP | 3104456 | A1 | 12/2016 |

OTHER PUBLICATIONS

The Written Opinion of the International Search Authority issued in corresponding International Application No. PCT/CN2016/100687, dated Nov. 29, 2016, 5 pages.
Extended European search report issued in corresponding European Application No. 16201650.5, dated May 17, 2017, 9 pages.
First Chinese Office Action (including English translation) issued in CN201510881118.4, dated Apr. 3, 2019, 20 pages.
Second Office Action of the Chinese Application No. 201510881118.4, dated Sep. 17, 2019 and English translation, (10p).

* cited by examiner

TERMINAL CASING AND TERMINAL

CROSS-REFERENCE TO RELATED APPLICATIONS

This application is filed based upon and claims priority to Chinese Patent Application No. 201510881118.4, filed on Dec. 3, 2015, the entire contents of which are incorporated herein by reference.

TECHNICAL FIELD

The embodiments of the present disclosure generally relate to the technical field of communications, and more particularly, to a terminal casing and a terminal.

BACKGROUND

Along with development of a communication technology, functions of a terminal become increasingly diversified and complicated, and more and more components are required to be mounted in a terminal body, so that a clearance area in the terminal body for designing of an antenna becomes increasingly small. Therefore, in many terminals, an antenna is replaced with a metal frame on a terminal casing to reduce occupation of the clearance area.

In a related technology, replacing a single antenna with a metal frame in a limited clearance area may meet requirements of a second-generation mobile communication technology and a third-generation mobile communication technology. However, for inter-band carrier aggregation in a carrier aggregation technology introduced into a Long Term Evolution Advanced (LTE-A) specification, since aggregated carriers are located in different working frequency bands, terminal antennae are required to be divided into a low and intermediate-frequency antenna and a high-frequency antenna when the terminal antennae are designed. Therefore, how to implement two antennae in a limited clearance area and ensure high isolation between the antennae under the condition of replacing an antenna with a metal frame is a problem urgent to be solved.

SUMMARY

According to a first aspect of the present disclosure, a terminal casing is provided. The terminal casing may include: a casing body, a metal frame, a first feeder unit, a second feeder unit and a main board grounding area. The metal frame may at least partially surround the casing body. The metal frame may include a top frame, two side frames and a bottom frame, and the bottom frame may include a horizontal part and two perpendicular parts, the horizontal part and the two perpendicular parts being divided by two gaps. The main board grounding area may be positioned in a specified area within the terminal casing, and may be connected with the two side frames of the metal frame. There may also be a clearance area positioned between the main board grounding area and the bottom frame within the terminal casing. The first feeder unit and the second feeder unit may be positioned in the clearance area. The first feeder unit and the horizontal part of the bottom frame may form a first antenna unit, and the second feeder unit and any perpendicular part of the bottom frame may form a second antenna unit orthogonal to the first antenna unit.

According to a second aspect of the embodiment of the present disclosure, a terminal is provided, which may include the terminal casing according to the first aspect.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this specification, illustrate embodiments consistent with the present disclosure and, together with the specification, serve to explain the principles of the present disclosure.

DETAILED DESCRIPTION

A terminal casing is provided in the present disclosure. The terminal casing includes a top frame, two side frames, and a bottom frame. The bottom frame is divided into the horizontal part and the two perpendicular parts by the two gaps in the bottom frame. The terminal casing also includes a clearance area that is positioned between the main board grounding area 104 and the bottom frame. The first feeder unit and the second feeder unit are arranged in the clearance area. The first feeder unit and the horizontal part of the bottom frame form the first antenna unit. The second feeder unit and any perpendicular part form the second antenna unit orthogonal to the first antenna unit. Since two antennae are respectively replaced with the horizontal part and any perpendicular part of the bottom frame of the metal frame in the limited clearance area, and the two antennae are orthogonally polarized by virtue of a perpendicular relationship therebetween, the terminal casing ensures high isolation between the two antennae.

In order to make a purpose, technical solutions and advantages of embodiments of the present disclosure clearer, implementation modes of the present disclosure will be further elaborated below with reference to the drawings.

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of devices and methods consistent with some aspects related to the present disclosure as recited in the appended claims.

Figure 1A:
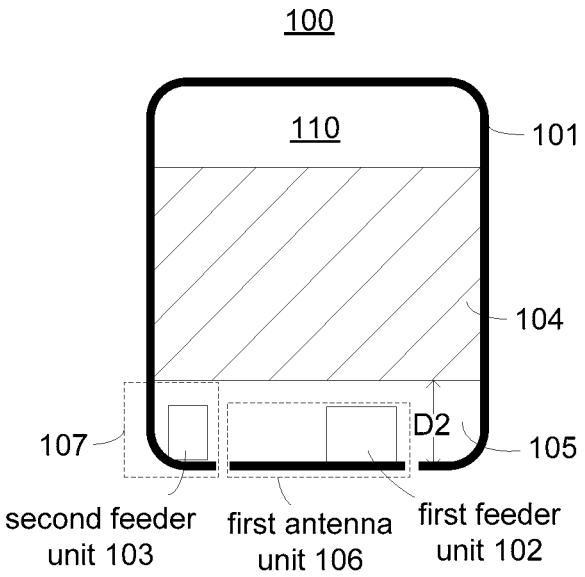
FIG. 1A is a schematic diagram of a terminal casing according to an exemplary embodiment.
Figure 1B:
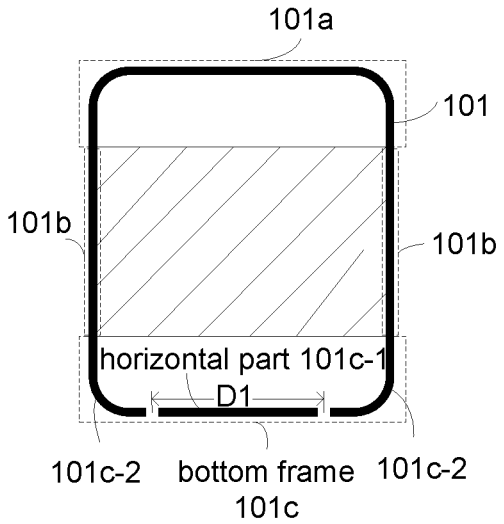
FIG. 1B is a schematic diagram of a terminal casing according to the exemplary embodiment.

FIG. 1A and FIG. 1B are structure diagrams of a terminal casing according to an exemplary embodiment, FIG. 1A and FIG. 1B are back views observed from a back surface of a terminal, and the terminal includes the terminal casing 100. As shown in FIG. 1A, the terminal casing 100 includes a casing body 110, a metal frame 101, a first feeder unit 102, a second feeder unit 103, and a main board grounding area 104.

Herein, the metal frame 101 may at least partially surrounds the casing body. For example, the metal frame 101 may surround side edge parts of the casing body 110. FIG. 1B is a structure diagram of the metal frame 101, the metal frame 101 includes a top frame 101*a*, two side frames 101*b* and a bottom frame 101*c*; and the bottom frame 101*c* includes a horizontal part 101*c*-1 and two perpendicular parts 101*c*-2, the horizontal part and the two perpendicular parts being divided by two gaps, herein the two perpendicular parts 101*c*-2 may be metal frames with a specified radian, and a numerical value of the specified radian may be 0, π/12, π/6, π/3, π/2, and the like, which will not be specifically limited in the embodiment of the present disclosure.

It is important to note that a distance D1 between the two gaps in the bottom frame 101*c* is 40 millimeters to 50 millimeters and is preferably 45 millimeters, and the two gaps are both filled with a nonconductive medium. Here, the nonconductive medium may be a plastic medium, a rubber medium and the like, which will not be specifically limited in the embodiment of the present disclosure.

The main board grounding area 104 is positioned in a specified area within the terminal casing, the specified area may be a middle area within the terminal casing, and the main board grounding area 104 is connected with the two side frames 101*b* of the metal frame 101 to ground the two side frames 101*b*. It is important to note that the main board grounding area 104 is a common grounding area of other components in the terminal.

There is also a clearance area 105 within the terminal casing, and the clearance area is positioned between the main board grounding area 104 and the bottom frame 101*c*, and the clearance area 105 is enclosed by a lower edge of the main board grounding area 104 and the bottom frame 101*c*. As the number of the components in the terminal increases and a height D2 of the clearance area is usually 6 millimeters to 9 millimeters, there is a limited area for antenna designing; and however, a low and intermediate-frequency antenna and high-frequency antenna required by inter-band carrier aggregation are implemented by virtue of such a limited clearance area in the embodiment of the present disclosure.

The first feeder unit 102 and the second feeder unit 103 are positioned in the clearance area 105. The first feeder unit and the horizontal part 101*c*-1 of the bottom frame form a first antenna unit 106, the second feeder unit and any perpendicular part 101*c*-2 of the bottom frame form a second antenna unit 107, and the first antenna unit 106 and the second antenna unit 107 are configured to implement LTE inter-band carrier aggregation, herein the horizontal part 101*c*-1 of the bottom frame is a radiation strip of the first antenna unit 106, and any perpendicular part 101*c*-2 of the bottom frame is a radiation strip of the second antenna unit 107.

In the embodiment of the present disclosure, the first antenna unit 106 and the second antenna unit 107 are both Planar Inverted F-shaped Antenna (PIFA). The first antenna unit 106 is a low and intermediate-frequency antenna, and its bandwidth is 800 MHz-2,170 MHz, wherein 800 MHz-960 MHz is a low frequency band and 1,710 MHz-2,170 MHz is an intermediate frequency band. The second antenna unit 107 is a high-frequency antenna, and its bandwidth is 2,300 MHz-2,690 MHz. A polarization manner for the first antenna unit 106 is horizontal polarization, and a polarization manner for the second antenna unit 107 is perpendicular polarization, so that polarizations of the first antenna unit 106 and of the second antenna unit 107 are orthogonal and their directional diagrams are orthogonal, isolation between the two antenna units is ensured, and radiation efficiency is improved.

In another embodiment, the first antenna unit 106 may be a high-frequency antenna, the second antenna unit 107 may be a low and intermediate-frequency antenna, and at this moment, only sizes and distances of each part of the first antenna unit 106 and the second antenna unit 107 are required to be correspondingly regulated.

It is important to note that two symmetric gaps may also be formed in the top frame of the metal frame 101 to ensure more attractive appearance of the terminal, the two symmetric gaps may be symmetric with the gaps in the bottom frame, and whether to form the gaps in the top frame or not and positions of the gaps will not be specifically limited in the embodiment of the present disclosure.

Figure 2:
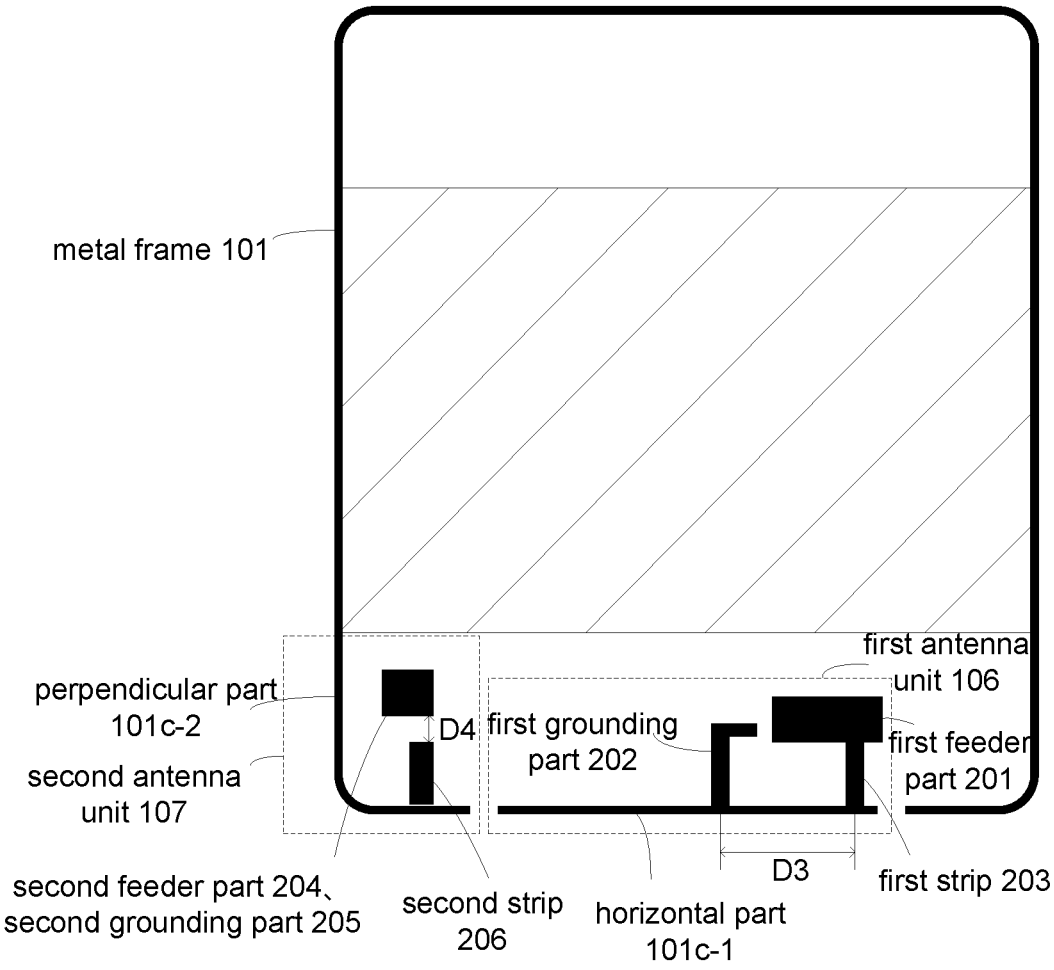
FIG. 2 is a schematic diagram of a terminal casing according to another exemplary embodiment.

FIG. 2 is another diagram of a terminal casing according to an exemplary embodiment, FIG. 2 is a back view observed from a back surface of a terminal, and the terminal includes a terminal casing. Referring to FIG. 2, the terminal casing includes the structure of the terminal casing shown in FIG. 1A and FIG. 1B, in addition, the first feeder unit 102 further includes a first feeder part 201, a first grounding part 202 and a first strip 203, and the second feeder unit 103 further includes a second feeder part 204, a second grounding part 205 and a second strip 206. In order to facilitate observation, FIG. 2 only references detailed structures of the metal frame 101, the first antenna unit 106 and the second antenna unit 107, and the other parts, which have been shown in FIG. 1A and FIG. 1B, of the terminal casing, except the metal frame 101, the first antenna unit and the second antenna unit, will not be referenced any more here.

The first feeder part 201 is connected with the horizontal part 101*c*-1 of the bottom frame 101*c* through the first strip 203, and the first grounding part 202 is also connected with the horizontal part 101*c*-1 of the bottom frame 101*c*, so that the first feeder unit and the horizontal part 101*c*-1 of the bottom frame 101*c* form the first antenna unit 106.

Herein, the first feeder part 201, the first grounding part 202 and the first strip 203 are all filled with a conductive substance, and during specific implementation, corresponding circuit areas may be filled with the conductive substance in a printing manner. The bottom frame between a connection point of the first strip 203 and the horizontal part 101*c*-1 of the bottom frame 101*c* and a connection point of the first grounding part 202 and the horizontal part 101*c*-1 of the bottom frame 101*c* is a ground-return strip of the first antenna unit 106 (i.e. a PIFA foot), and a length D3 of the ground-return strip is 10 millimeters to 20 millimeters, and is preferably 15 millimeters.

The second feeder part 204 and the second grounding part 205 are positioned in the same conductive substance filled area. The second strip 206 is filled with a conductive substance, and is connected with any perpendicular part 101*c*-2 of the bottom frame 101*c*.

Herein, the second strip 206 is positioned below the second feeder part 204, forms a gap with the second feeder part 204, and is configured to form a coupled circuit with the second feeder part 204 and perform coupled feeding, so that the second feeder unit 103 and any perpendicular part 101*c*-2 of the bottom frame 101*c* form the second antenna unit 107, wherein a width D4 of the gap between the second strip 206 and the second feeder part 204 is 1 millimeter to 4 millimeters, and the width of the gap is preferably 2 millimeters.

It is important to note that each of the first grounding part 202, the first strip 203 and the second strip 204 may be connected with the bottom frame 101*c* through an elastic piece, wherein the elastic piece is a conductive substance, and such a connection manner is contact connection; and they may also be connected with the bottom frame 101*c* through fixing bolts, and such a connection manner is fixed connection. There are no specific limits made to the connection manner in the embodiment of the present disclosure.

It is important to note that FIG. 2 only shows the condition that the second strip 206 is connected with the perpendicular part 101*c*-2 at a left end and the connection point of the first strip 203 and the horizontal part 101*c*-1 is on a right side of the first grounding part and the horizontal part 101*c*-1 and is closer to the gap in a right end. In another embodiment, the second strip 206 may also be connected with the perpendicular part 101*c*-2 at the right end, and the connection point of the first strip 203 and the horizontal part 101*c*-1 is on a left side of the first grounding part and the horizontal part 101*c*-1 and closer to the gap in the left end. There are no specific limits in the embodiment of the present disclosure.

Figure 3:
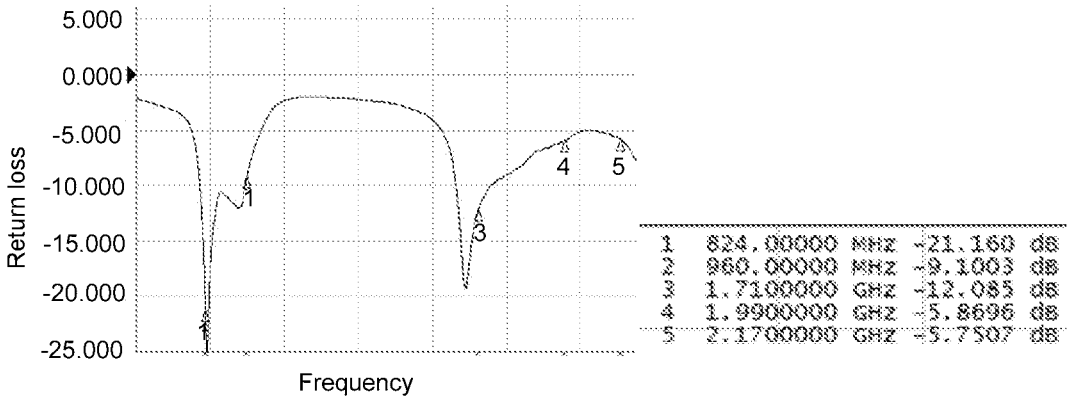
FIG. 3 is a chart illustrating the return loss curve of a first antenna unit according to an exemplary embodiment.

FIG. 3 is a chart illustrating the return loss curve of a first antenna unit according to an exemplary embodiment. The return loss curve shows return loss in dB (vertical axis) as a function of frequency in Hz (horizontal axis). For example, if the first antenna unit is a low and intermediate-frequency antenna, the height D2 of the clearance area is 8 millimeters, the distance D1 between the two gaps in the bottom frame 101*c* is 45 millimeters and the distance D3 between the connection point of the first strip 203 and the horizontal part 101*c*-1 of the bottom frame 101*c* and the connection point of the first grounding part 102 and the horizontal part 101*c*-1 of the bottom frame 101*c* is 15 millimeters, as shown in FIG. 3, the return loss of the first antenna unit in the low frequency band of 800 MHz-960 MHz and the intermediate frequency band of 1,710 MHz-2,170 MHz is below −5 dB, and meets an antenna design requirement.

Figure 4:
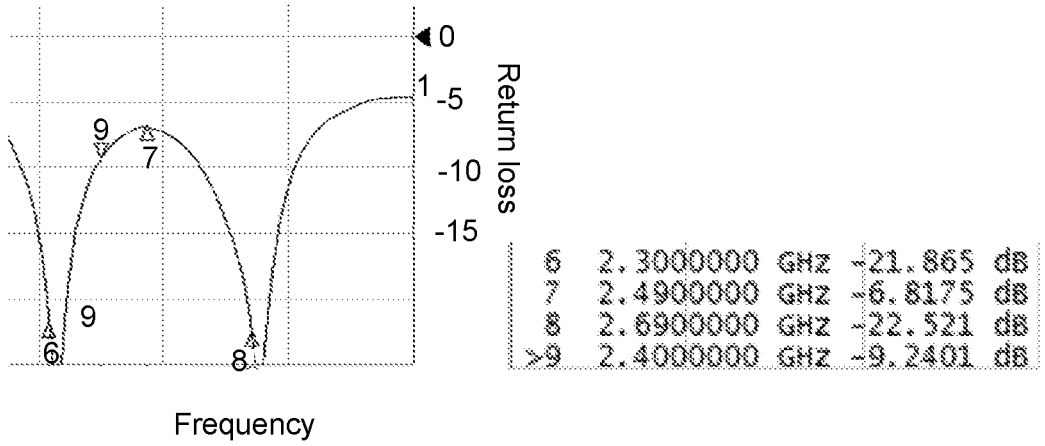
FIG. 4 is a chart illustrating the return loss curve of a second antenna unit according to an exemplary embodiment.

FIG. 4 is a chart illustrating the return loss curve of a second antenna unit according to an exemplary embodiment. The return loss curve shows return loss in dB(vertical axis) as a function of frequency in Hz (horizontal axis). For example, if the second antenna unit is a high-frequency antenna, the height D2 of the clearance area is 8 millimeters and the width D4 of the gap between the second strip 206 and the second feeder part 204 is 2 millimeters, as shown in FIG. 4, the return loss of the first antenna unit in the high frequency band of 2,300 MHz-2,690 MHz is below −5 dB, and meets an antenna design requirement.

Figure 5:
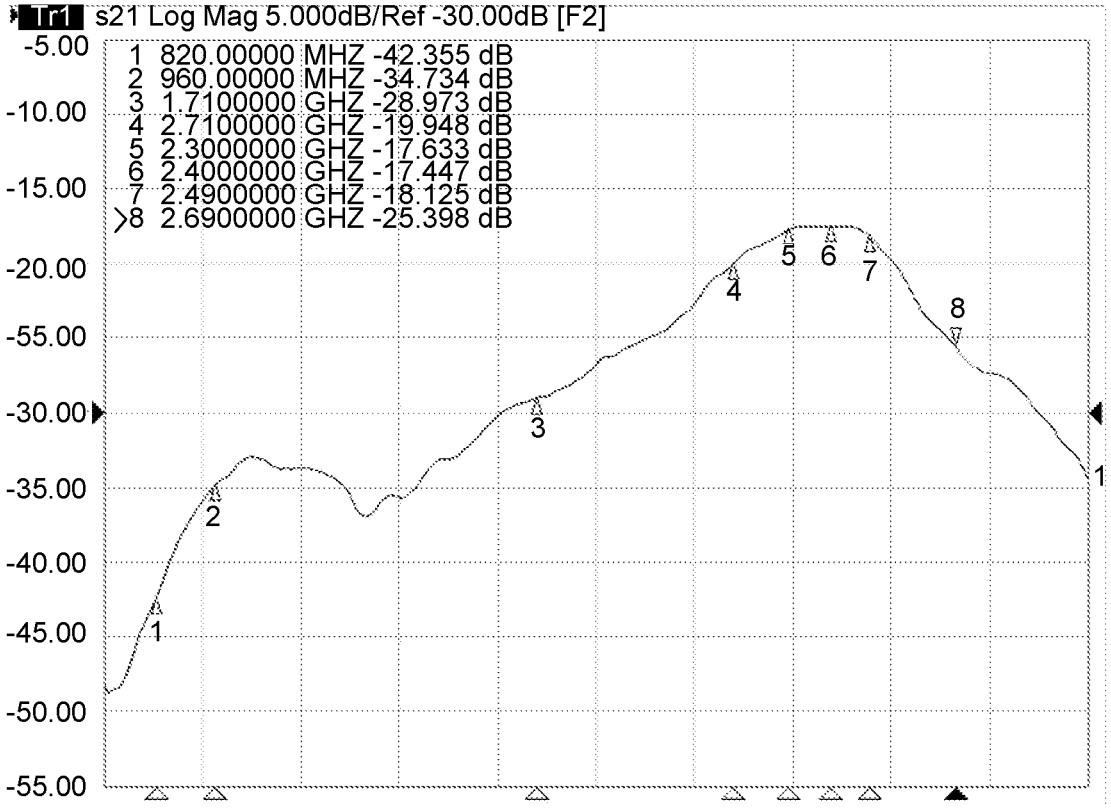
FIG. 5 is a chart illustrating the isolation curve between a first antenna unit and a second antenna unit according to an exemplary embodiment.

FIG. 5 is a chart illustrating the isolation curve between a first antenna unit and a second antenna unit according to an exemplary embodiment. The isolation curve shows isolation in dB (vertical axis) as a function of frequency in Hz (horizontal axis). For example, if the first antenna unit is a low and intermediate-frequency antenna, D1 is equal to 45 millimeters, D2 is equal to 15 millimeters, the second antenna unit is a high-frequency antenna and D3 is equal to 2 millimeters, as shown in FIG. 5, isolation between the first antenna unit and the second antenna unit within the whole LTE frequency band of 800 MHz-2,690 MHz is below −15 dB, and meets a requirement of an LTE inter-band carrier aggregation technology on antenna isolation.

According to the terminal casing provided by the embodiment of the present disclosure, the bottom frame is divided into the horizontal part and the two perpendicular parts by the two gaps in the bottom frame of the metal frame; and the first feeder unit and the second feeder unit are arranged in the clearance area, the first feeder unit and the horizontal part of the bottom frame form the first antenna unit, and the second feeder unit and any perpendicular part form the second antenna unit orthogonal to the first antenna unit. Since two antennae are replaced with the horizontal part and any perpendicular part of the bottom frame of the metal frame in the limited clearance area respectively, and the two antennae are orthogonally polarized by virtue of a perpendicular relationship therebetween, high isolation between the two antennae is ensured.

The embodiment of the present disclosure further provides a terminal, and the terminal includes a terminal casing involved in the abovementioned embodiment and includes all structures and functions of the terminal casing, which will not be elaborated herein. The terminal may further include a front terminal casing, a terminal display screen and other electronic components in the terminal. A first antenna unit and second antenna unit formed within the terminal casing are matched with the other electronic components in the terminal to work to realize a communication function of the terminal. A specific structure of the terminal will not be limited in the present disclosure.

The terminology used in the present disclosure is for the purpose of describing exemplary embodiments only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Other embodiments of the present disclosure will be apparent to those skilled in the art from consideration of the specification and practice of the present disclosure. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

What is claimed is:

1. A terminal casing, comprising:

a casing body;

a metal frame at least partially surrounding the casing body, the metal frame comprising a top frame, two side frames and a bottom frame, and the bottom frame comprising a horizontal part and two perpendicular parts, the horizontal part and the two perpendicular parts being divided by two gaps, wherein a distance between the two gaps in the bottom frame is 40 millimeters to 50 millimeters to reduce a return loss to be below −5 dB for a low frequency band of 800 MHz to 960 MHz and an intermediate frequency band of 1710 MHz to 2170 MHz;

a main board grounding area positioned in an area within the terminal casing, and is connected with the two side frames of the metal frame; and a first feeder unit and a second feeder unit positioned in a clearance area positioned between the main board grounding area and the bottom frame within the terminal casing, wherein the first feeder unit and the horizontal part of the bottom frame form the first antenna unit, and the second feeder unit and any perpendicular part of the bottom frame form a second antenna unit orthogonal to the first antenna unit, wherein the second feeder unit comprises a second feeder part, a second grounding part and a second strip, the second feeder part and the second grounding part are positioned in the same conductive substance filled area, and the second strip is filled with a conductive substance and is connected with any perpendicular part of the bottom frame; and wherein the second strip is positioned below the second feeder part, a gap is disposed between the second strip and the second feeder part, and the second strip is configured for coupled feeding with the second feeder part, so that the second feeder unit and any perpendicular part of the bottom frame form the second antenna unit, wherein a width of the gap between the second strip and the second feeder part is 1 millimeter to 4 millimeters to reduce the return loss to be below −5 dB for a high frequency band of 2300 MHz to 2690 MHz.

2. The terminal casing according to claim 1, wherein the first feeder unit comprises a first feeder part, a first grounding part and a first strip, the first feeder part is connected with the horizontal part of the bottom frame through the first strip, and the first grounding part is connected with the horizontal part of the bottom frame, so that the first feeder unit and the horizontal part of the bottom frame form the first antenna unit; and the first feeder part, the first grounding part and the first strip are all filled with a conductive sub stance.

3. The terminal casing according to claim 2, wherein a distance between a connection point of the first strip and the horizontal part of the bottom frame and a connection point of the first grounding part and the horizontal part of the bottom frame is 10 millimeters to 20 millimeters.

4. The terminal casing according to claim 2, wherein the first grounding part is connected with the horizontal part of the bottom frame through an elastic piece, the elastic piece being a conductive substance.

5. The terminal casing according to claim 2, wherein the first strip is connected with the horizontal part of the bottom frame through a second elastic piece, the elastic piece being a conductive substance.

6. The terminal casing according to claim 1, wherein the second strip is connected with any perpendicular part of the bottom frame through a third elastic piece, the elastic piece being a conductive substance.

7. The terminal casing according to claim 1, wherein the two gaps in the bottom frame are filled with a nonconductive medium.

8. The terminal casing according to claim 7, wherein the nonconductive medium is a plastic medium.

9. The terminal casing according to claim 1, wherein the two gaps in the bottom frame are symmetric about a symmetry axis which is a perpendicular bisector of the metal frame.

10. The terminal casing according to claim 1, wherein the first antenna unit and the second antenna unit are both Planar Inverted F-shaped Antennae (PIFA).

11. The terminal casing according to claim 1, wherein the first antenna unit is a low and intermediate-frequency antenna, and the second antenna unit is a high-frequency antenna.

12. The terminal casing according to claim 1, wherein the first antenna unit is a high-frequency antenna, and the second antenna unit is a low-frequency antenna.

13. The terminal casing according to claim 1, wherein a polarization manner for the first antenna unit is horizontal polarization, and a polarization manner for the second antenna unit is perpendicular polarization.

14. The terminal casing according to claim 1, wherein the two perpendicular parts of the bottom frame are metal frames with a specified radian.

15. A terminal, comprising a terminal casing that comprises a casing body, a metal frame, a first feeder unit, a second feeder unit, and a main board grounding area, wherein the metal frame at least partially surrounds the casing body;

the metal frame comprises a top frame, two side frames and a bottom frame, and the bottom frame comprises a horizontal part and two perpendicular parts, the horizontal part and the two perpendicular parts being divided by two gaps, wherein a distance between the two gaps in the bottom frame is 40 millimeters to 50 millimeters to reduce a return loss to be below −5 dB for a low frequency band of 800 MHz to 960 MHz and an intermediate frequency band of 1710 MHz to 2170 MHz;

the main board grounding area is positioned in a specified area within the terminal casing, and is connected with the two side frames of the metal frame;

there is also a clearance area positioned between the main board grounding area and the bottom frame within the terminal casing;

the first feeder unit and the second feeder unit are positioned in the clearance area; and the first feeder unit and the horizontal part of the bottom frame form a first antenna unit, and the second feeder unit and any perpendicular part of the bottom frame form a second antenna unit orthogonal to the first antenna unit, wherein the second feeder unit comprises a second feeder part, a second grounding part and a second strip, the second feeder part and the second grounding part are positioned in the same conductive substance filled area, and the second strip is filled with a conductive substance and is connected with any perpendicular part of the bottom frame; and wherein the second strip is positioned below the second feeder part, a gap is disposed between the second strip and the second feeder part, and the second strip is configured for coupled feeding with the second feeder part, so that the second feeder unit and any perpendicular part of the bottom frame form the second antenna unit, wherein a width of the gap between the second strip and the second feeder part is 1 millimeter to 4 millimeters to reduce the return loss to be below −5 dB for a high frequency band of 2300 MHz to 2690 MHz.

16. The terminal according to claim 15, wherein the first feeder unit comprises a first feeder part, a first grounding part and a first strip, the first feeder part is connected with the horizontal part of the bottom frame through the first strip, and the first grounding part is connected with the horizontal part of the bottom frame, so that the first feeder unit and the horizontal part of the bottom frame form the first antenna unit; and the first feeder part, the first grounding part and the first strip are all filled with a conductive sub stance.

17. The Terminal according to claim 16, wherein a distance between a connection point of the first strip and the horizontal part of the bottom frame and a connection point of the first grounding part and the horizontal part of the bottom frame is 10 millimeters to 20 millimeters.

* * * * *